United States Patent [19]

Carlson

[11] Patent Number: 4,978,099

[45] **Date of Patent: * Dec. 18, 1990**

[54] CHAMFER STRIP AND ADJUSTABLE CORNER SQUARING STRIP FOR A CONCRETE COLUMN FORM

[75] Inventor: Michael G. Carlson, Lenexa, Kans.

[73] Assignee: Western Forms, Inc., Kansas City, Mo.

[ * ] Notice: The portion of the term of this patent subsequent to Dec. 11, 2007 has been disclaimed.

[21] Appl. No.: 307,893

[22] Filed: Feb. 7, 1989

[51] Int. Cl.[5] ..... E04G 13/02

[52] U.S. Cl. ..... 249/48; 249/159; 249/193; 249/194; 249/219.1; 425/DIG. 106

[58] Field of Search ..... 249/47, 48, 135, 152, 249/159, 163, 166, 170, 188, 192, 193, 194, 219.1; 425/DIG. 106; 52/35, 100, 242, 288

[56] References Cited

U.S. PATENT DOCUMENTS

| | | | |
|---|---|---|---|
| 1,331,096 | 2/1920 | Eaches | 425/DIG. 106 |
| 1,694,292 | 12/1928 | Tracey | 249/27 |
| 2,222,339 | 11/1940 | Schnek | 249/214 |
| 2,953,835 | 9/1960 | Armstrong et al. | 249/188 |
| 3,857,540 | 12/1974 | Ecker | 249/48 |
| 3,945,601 | 3/1976 | Rowley | 249/194 |
| 4,042,205 | 8/1977 | Herrell | 425/DIG. 106 |
| 4,320,888 | 3/1982 | Oury | 249/45 |
| 4,465,257 | 8/1984 | Schimmel | 249/11 |

FOREIGN PATENT DOCUMENTS

| | | | |
|---|---|---|---|
| 0062420 | 10/1982 | European Pat. Off. | 249/44 |
| 2260334 | 6/1974 | Fed. Rep. of Germany | 249/188 |
| 2348117 | 4/1975 | Fed. Rep. of Germany | 249/188 |

OTHER PUBLICATIONS

Euro Form brochure, Wall-Slab-Column.
Deslauriers brochure, Forms for Concrete Columns.
Symons brochure, Steel-Ply Concrete Forming System.
Gates brochure, Cam-Lock Forming System.
Western Forms brochures, Aluminum Forming Systems.
Betomol brochure, Betomol Formwork System.
Paschal Formworks brochure, Trapezoidal Grider Formwork.
Symons brochure, Symons Wall Form Construction.
Roos Column Clamps Brochure.
EFCO Lite, Custom Column and Beam Forms Brochure.

*Primary Examiner*—James C. Housel
*Attorney, Agent, or Firm*—Wm. Bruce Day

[57] ABSTRACT

An adjustable corner strip for joining adjacent concrete form panels into a column mold includes spaced diverging wings with slots to retain adjustment screws for adjusting the divergence of the wings, and thus the panels. The corner strip permits easy and rigid squaring of forms. A chamfer strip includes a chamfer face and an integrally formed tail section extending outwardly of the strip and adapted to fit into the channel formed along the mold side rail. The adjustable corner strips bring the chamfer strips into tight mating engagement with the interior surfaces of the mold panels, preventing leakage of cement between the chamfer strips and the mold panels.

3 Claims, 2 Drawing Sheets

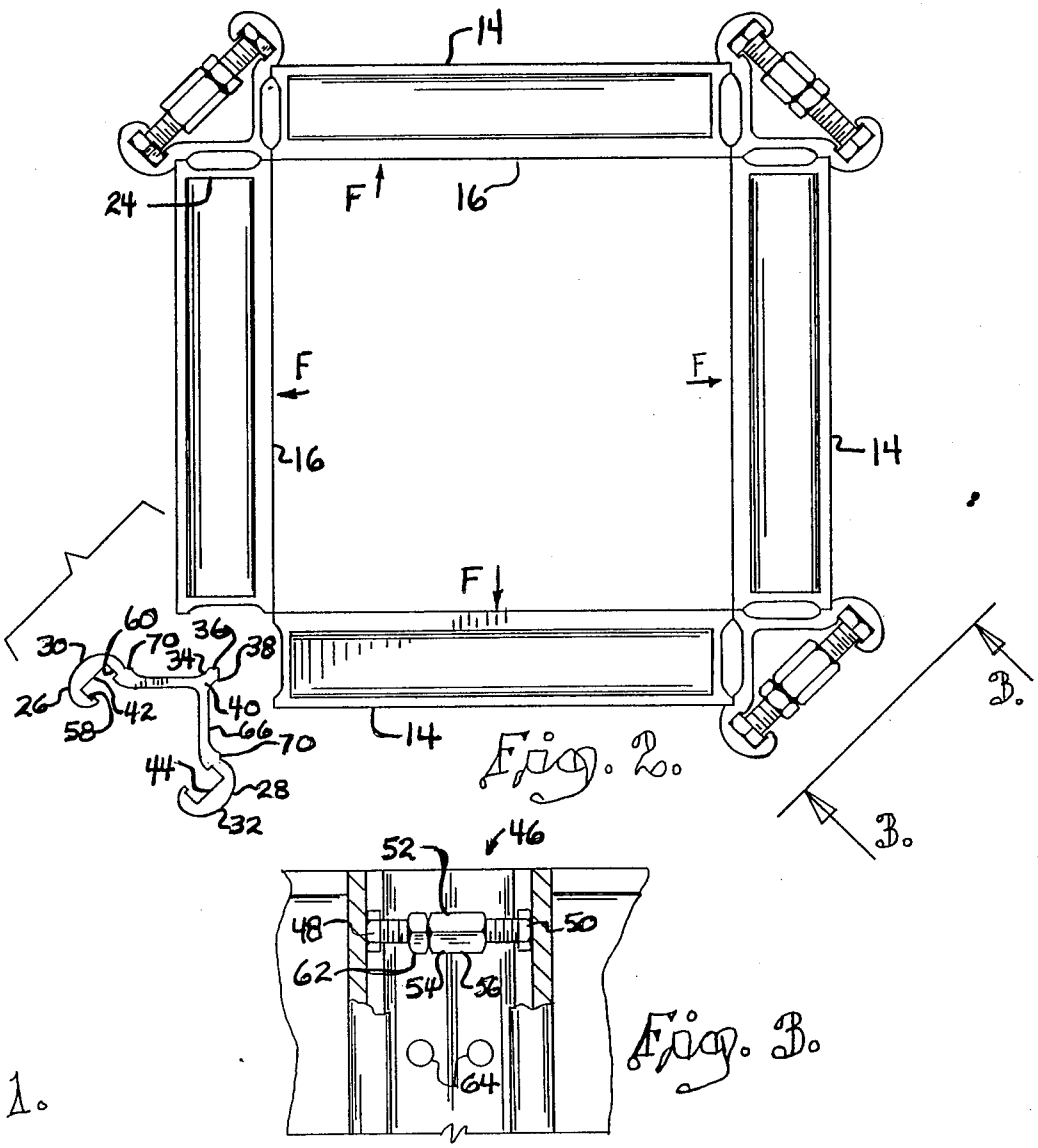
Fig. 2.
Fig. 3.
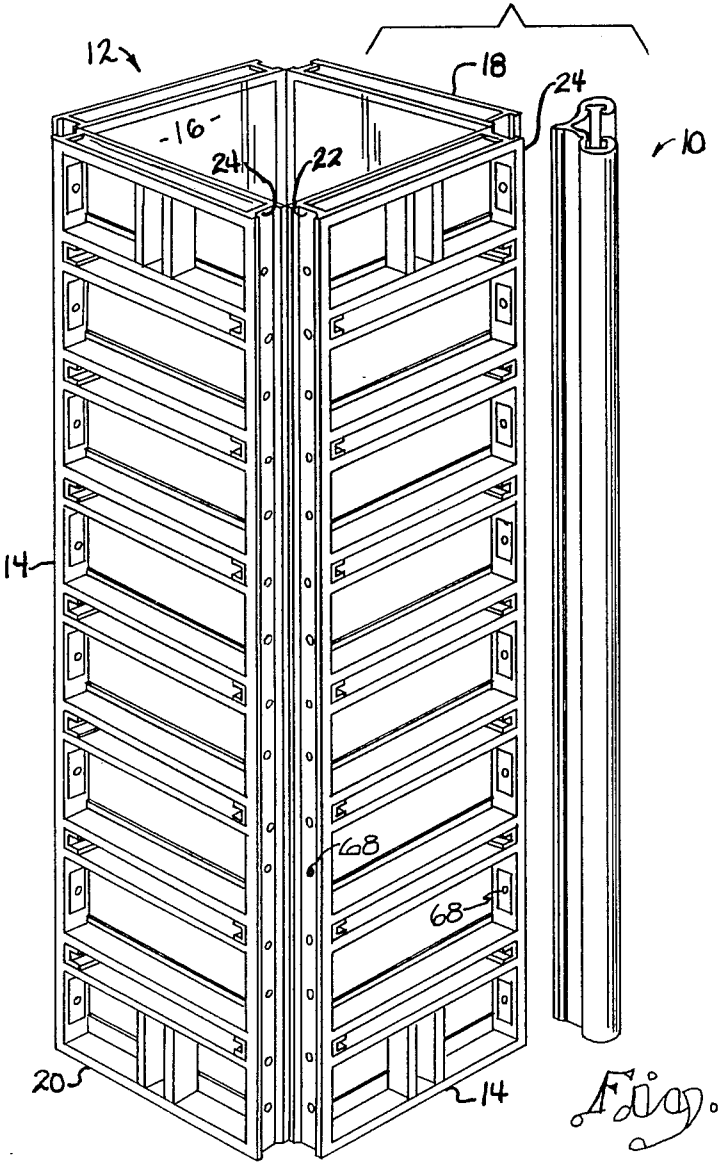
Fig. 1.

CHAMFER STRIP AND ADJUSTABLE CORNER SQUARING STRIP FOR A CONCRETE COLUMN FORM

FIELD OF THE INVENTION

This invention relates to a chamfer system for a concrete column form and an adjustable squaring strip for concrete column forms, both for use with concrete forms assembled from panels. More particularly, the invention is directed to such systems that can be easily secured to concrete form panels without the use of fasteners that penetrate the panels and can be used to bring into square relationship columns made from form panels.

BACKGROUND OF THE INVENTION

Multi-story structures, such as office buildings and parking garages, are often built one story at a time from reinforced poured concrete. Such structures require numerous concrete pillars or columns for their structural support. In the case of square or rectangular cross section columns, many columns are constructed with a chamfer or bevel along the whole length of each vertical edge of the column.

To make high-rise buildings, it is imperative that each stack of columns be precisely aligned along a single vertical center line. Thus, when each story is poured, each column must be squared, that is, adjoining faces of the column walls must all meet at a 90° angle throughout the length of the column and be plumbed. If the alignment of columns is off only slightly in each story, the cumulative effect of errors will result in a structure that is substantially weaker than its designers intended.

When a floor has been built and more stories will be added on top of it, carpenters using two-by-four timbers layout a full-sized template of supporting columns. The size of the template for a concrete column is just large enough to accommodate an assembled concrete form. The form itself, then, must be set up in a remote location, generally a handy open area twenty or more feet from the installation site. In work according to the prior art, to set up, pour, and strip the form from a finished eight foot concrete column normally requires approximately eight man hours of work per column at a cost of approximately $125 per column in labor. The problems encountered in pouring and finishing such columns to an acceptable level account for the large effort required.

Typically, forms for columns are assembled from form panels that are fastened together to form a mold panel. Such form panels typically include a frame of aluminum and a mold surface of high density plywood or high density overlay plywood, which has phenolic coating, which extends the life of the panel.

Chamfer strips of the prior art typically are wood or extruded plastic chamfer strips that are nailed to the plywood panels of the forms. The practice of using wood or plastic chamfer strips creates several problems. First, they are difficult to install, requiring at best about twenty minutes each to install. Their installation requires a man to be inside the form, which means at least one side of the form must be left open while one worker applies the chamfer strips along the inside edges of the form. Since the form is typically only large enough to allow one worker to enter it, other workers may be idle while the chamfer strips are being nailed on.

Second, when the plywood or high density overlay plywood is punctured, concrete, moisture, mold spores and so on find their way into the interior of the wood panel. When chamfer strips are repeatedly nailed to the plywood, a great many holes are formed in the plywood close to the metallic frame. These two processes dramatically reduce the useful life of the mold panel, which is expensive to replace.

Third, after the form is closed, squared, and moved into position on the floor template, one or more chamfer strips frequently come loose, requiring the column form to be removed from the template, reopened and fixed. Finally, the forces created by pouring concrete into the form frequently rip one or more chamfer strips from the form panel. These strips may disappear and become wholly-embedded in the column. A portion of the chamfer strip may break off and a portion of it may protrude from the finished column. Less dramatically, concrete frequently seeps between the edges of the column form panels and the chamfer strip. In all such cases, when the form panels are removed, the chamfer is either imperfectly formed or not formed at all. Building inspectors routinely insist that the chamfers on these columns meet the plan specifications, requiring substantial amount of work in grinding to put a chamfer on the finished column.

Not surprisingly, after such abuse, chamfer strips according to the prior art can be used only one to three times at a maximum before they must be discarded. In addition, extruded plastic chamfer material suffers from several disadvantages of its own. At the job site, it is typically stacked in a pile and each strip assumes whatever shape gravity dictates, so that each becomes deformed and cannot be straightened out, especially in cold weather. Forces bearing on them during form set up and concrete pouring also tend to distort them, by pushing them beyond their yield point.

Typically, the four mold panels of a prior art form system are held together by a simple corner flange approximately 90°, or angle iron disposed along each vertical edge of the panels and bolted thereto. Each form is individually squared, primarily by twisting the panels until all the diagonals of the open ends of the form are the same length and inserting loose shims or spacers between the corner flange and the mold panels, then tightening the bolts that hold the angle iron to the side rails while the form is in its remote location. Given the weight of the form panels themselves, and the forces exerted on them as the form is moved from the set up location to the pouring location, torsion frequently twists the column form so that it is out of square after being moved to the pouring site. In addition the shims frequently fall out during the moving of the form, and must be reinserted. The prior art corner strip does not effectively resist or adjust for these torsional forces and cannot maintain a 90° angle between the wings.

Accordingly, there is a need for a system for forming a mold for a concrete column that reduces the high labor costs associated with pouring concrete columns; that reduces the difficulty of applying chamfer strips to the inside of the form; that provides a good square fit between the interior edges of the form panels and the legs of the chamfer strip; that provides a chamfer strip that will not come loose during pouring; that provides a chamfer strip that will not reduce the service life of the form panels; that eliminates extra labor costs involved in chamfering a column on which no chamfer was formed during the molding process; that provides chamfer strip having an extended or indefinite life; that provides chamfer strip that will not warp; that provides a form for a concrete column that can be easily squared and will remain square while the form is moved from the set up site to the pouring site; and that significantly strengthens the assembled form panels, thereby allowing lighter-weight form panels to be used in a given application.

OBJECTS OF THE INVENTION

Accordingly, it is a primary object of the present invention to provide a chamfer strip and adjustable squaring strip for a concrete column form that reduces the high labor costs associated with pouring concrete columns.

It is another object of the present invention to provide a chamfer strip and adjustable squaring strip for a concrete column form that reduces the difficulty of applying chamfer strips to the inside of the form.

It is still another object of the present invention to provide a chamfer strip and adjustable squaring strip for a concrete column form that provides a good square fit between the interior edges of the form panels and the legs of the chamfer strip.

It is still another object of the present invention to provide a chamfer strip and adjustable squaring strip for a concrete column form that provides a chamfer strip that will not come loose during pouring.

It is still another object of the present invention to provide a chamfer strip and adjustable squaring strip for a concrete column form that will not reduce the service life of the form panels.

It is a further object of the present invention to provide a chamfer strip and adjustable squaring strip for a concrete column form that eliminates extra costs involved in chamfering a column on which no chamfer was formed during the molding process by ensuring that a chamfer will be formed whenever desired.

It is a still further object of the present invention to provide a chamfer strip and adjustable squaring strip for a concrete column form that provides a chamfer strip having an extended or indefinite life.

It is a further object of the present invention to provide a chamfer strip and adjustable squaring strip for a concrete column form that includes a chamfer strip that will not warp.

It is a still further object of the present invention to provide a chamfer strip and adjustable squaring strip for a concrete column form that provides a form for a concrete column that can be easily squared and will remain square while the form is moved from the set up site to the pouring site.

It is still another object of the present invention to provide a chamfer strip and adjustable squaring strip for a concrete column form that significantly strengthens the assembled form panels, thereby allowing lighter-weight form panels to be used in a given application.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a perspective view illustrating a preferred embodiment of the present invention shown in its normal relationship with an assembled concrete column form made from form panels.

FIG. 2 is a plan view of the column form of FIG. 1 showing the adjustable squaring strip in use with the concrete form.

FIG. 3 is a sectional view taken along lines 3—3 of FIG. 2.

DESCRIPTION OF THE PREFERRED EMBODIMENT

Figure 6:
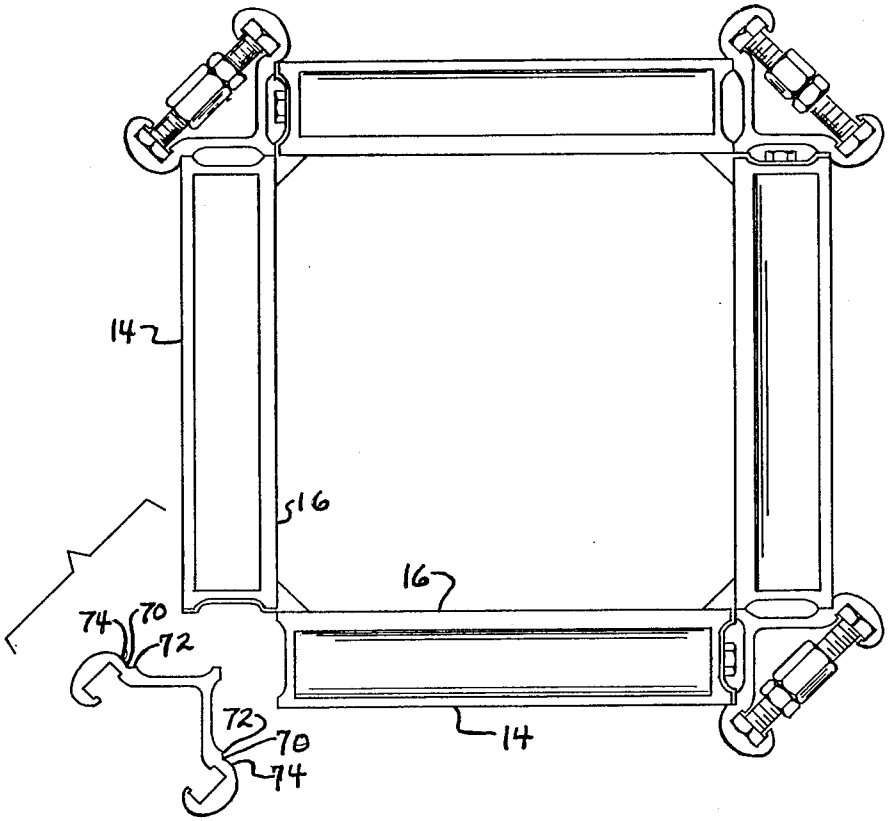
FIG. 6 is a plan view of the column form shown in FIG. 1, illustrating the chamfer strip and adjustable squaring strip installed on a concrete column form according to the present invention.

As required by the statutes, a detailed embodiment of the present invention is disclosed herein, however, that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIG. 1, an adjustable corner strip 10 is used to fasten an assemblage of concrete form panels, or form 12 together, such as in the column form shown in FIG. 1. Each separate form panel 14 includes a face 16 for contact with the poured concrete, top rail 18, bottom rail 20, and spaced side rails 22, 24. Arranged in a configuration having square or rectangular cross sections throughout its length, the form includes opposite side rails 22, 24 each connected to the adjoining side rails of the next form panel 14 by adjustable corner strip 10.

Referring to FIG. 2, the adjustable corner strip 10 is a single, extruded member, preferably made from aluminum, having spaced opposing wings 26, 28, each terminating in a rounded head 30, 32, respectively. Wings 26, 28 extend perpendicularly from arm portion 34 and are flexible, yet strongly resilient. Arm portion 34 terminates in perpendicular faces 36, 38 for engaging against a 90° outside corner between perpendicularly arranged panel side rails 22 or 24. Wings 26, 28 become progressively thinner along the direction from rounded heads 30, 32 to perpendicular faces 36, 38 to allow resilient deflection about the juncture 40. A preferred material for adjustable corner strip 10 is 6061-T6 aluminum, which provides for sufficient rigidity without being brittle, which could cause cracking upon flexing. Adjustable corner strip 10 may be extruded and cut to any convenient length. Multiple lengths may be used on a single concrete column form panel. Such columns are typically about eight feet long.

Rounded heads 30, 32 include longitudinal slots 42, 44, respectively, extending the length of adjustable corner strip 10 and opposing and facing one another for receiving a plurality of adjustment means 46.

Referring to FIG. 3, there is shown adjustment means 46, comprising right-hand screw 48, left-hand screw 50, having screw shafts in confronting relationship and being threaded int adjusting nut 52, having right-hand threaded portion 54 and left-hand threaded portion 56. Right-hand screw 48 is threaded into right-hand threaded portion 54 and left-handed screw 50 is threaded into left-hand threaded portion 56 of adjustment nut 52. The heads of bolts 48, 50 fit into longitudinal slots 42, 44 so that two opposing flats of each bolt head bear against side walls 58, 60 of longitudinal slots 42, 44 to prevent rotation of the bolts upon adjustment. The described arrangement of adjustment means 46 permits the adjustment means to be lengthened or shortened by turning adjusting nut 52 in one direction. When the desired adjustment has been reached, jamb nut 62 is tightened against adjusting nut 52 to prevent slippage.

A plurality of fastening means 46 are equally spaced throughout the length of each adjustable corner strip 10, typically about two feet apart. If desired, filler strips of spongy, resilient material may be urged into longitudinal slots 42, 44 between adjacent adjustment means 46 to prevent them from becoming improperly spaced. It is not intended that adjustment means 46 be removed from adjustable corner strip 10 in the ordinary course of use.

To secure adjustable squaring corner strip 10 to form panel side rails 22, 24, there is provided a plurality of holes 64. Holes 64 are provided in pairs on opposed, facing straight portions 66 of wings 26, 28. Pairs of holes 64 are longitudinally spaced throughout the length of adjustable corner strip 10 and match the spacing and size of holes 68 in side rails 22, 24. When holes 64 and 68 are aligned, a fastener, such as a bolt or pin, is inserted through both holes and secured by a nut or other means. It is preferred that holes 64 are also aligned with fastening means 46. In an alternative embodiment adjustable corner strip 10 does not include holes 64, but is fastened to side rails 22, 24 by conventional clamps, which may be a C-shaped spring-loaded clamp whose clamping ends are engaged about a side rail 22 and adjustable corner strip 10 by driving wedges into the clamp.

In use, the adjustable corner strip is attached into place to connect the side rails of perpendicularly positioned form panels. Some adjustment is required to bring the column form into square alignment, which is done by turning adjustment nut 52 on each of the adjustment means throughout the length of each side of the column until the diagonals of the two open ends of the form are equal. The jamb nut 62 and adjusting nut 52 are tightened together to prevent slippage. Turning adjusting nut 52 either spreads wings 26, 28 further apart, or draws them closer together, as required. In practice, it has been found that an adjustment of up to eight degrees deviation from the desired right angle between adjacent form panels can be made with the adjustable corner strip 10. Since wings 26, 28 bear directly against the outside edge of the form panel and are secured thereto by notches 70 in each wing, moving wings 42, 44 also causes adjacent form panels 14 to move.

Notches 70 naturally run the entire length of adjustable corner strip 10, presenting the appearance of a groove or channel in adjustable corner strip 10. Notches 70 are V-shaped having side walls 72, 74 which meet at a 90° angle and accordingly mate in locking engagement with the 90° angle of the edge of side rails 22, 24. Naturally, notches 70 are spaced apart by the distance required to bring them into mating engagement with the 90° angle of the edge of each of side rails 22, 24 (see, especially, FIG. 6). Although relatively shallow in appearance, notches 70 provide an extremely tight grip on side rails 22, 24, permitting adjustable corner strip 10 to maintain the squared up shape of a completed column mold under severe loads.

After adjustable corner strip 10 has been installed and adjusted as discussed above, it forms a springing resilient reinforcement member providing a triangular reinforcement of the open square formed by the convergence of spaced side rails 22, 24. Forces generated by the poured concrete at the bottom of an eight foot column may exceed 1,250 pounds per square foot. As illustrated in FIG. 2, by the arrows labeled "F," these forces tend to bow form panels 14, but these outward forces are largely translated into longitudinal forces that flow through the metal frame outwardly toward spaced side rails 22, 24. When these corner joints are secured by adjustable corner strip 10, combined with adjustment means 46, any force tending to bend one form panel outwardly is translated into a stiffening force through both wings 26, 28. The outside corner angle is prevented from flexing by the rigid corner support provided by adjustable corner strip 10, which also prevents outward rotational motion of side rails 22, 24. In this manner, adjustable corner strip 10 increases end fixity and overall mold rigidity by about 30%, allowing the use of lighter-weight form panels.

Figure 4:
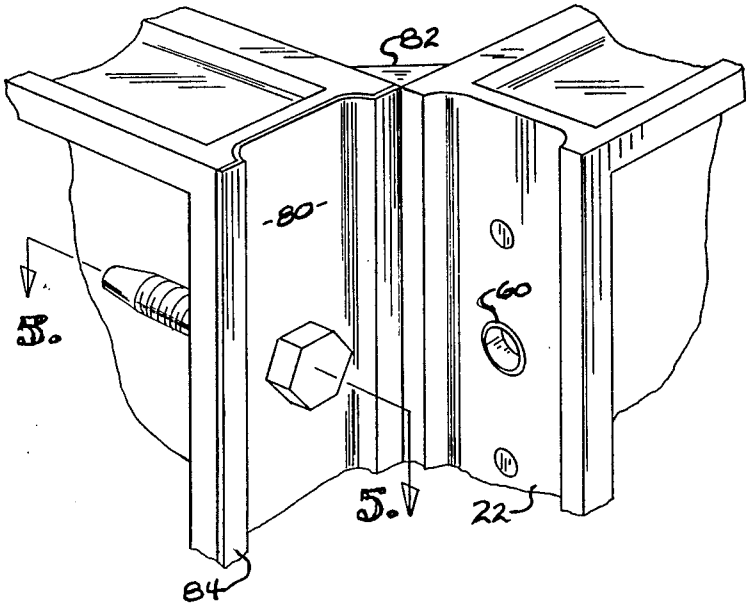
FIG. 4 is a fragmentary perspective view of the juncture of two form panels of an assembled concrete column form, illustrating an installed chamfer strip according to the present invention.
Figure 5:
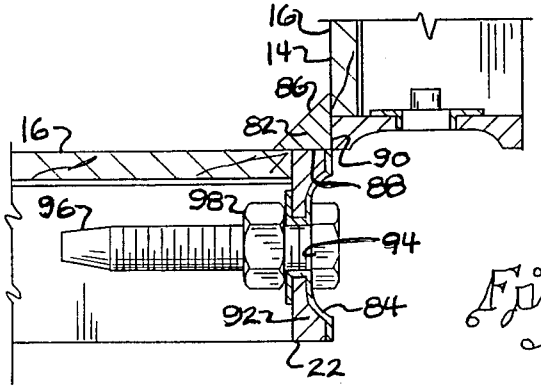
FIG. 5 is a sectional view taken along lines 5—5 of FIG. 4.

Often it is desired to install a chamfer on each corner of a poured concrete column. Referring to FIG. 4, there is shown chamfer strip 80, comprising chamfer portion 82 and tail 84. Chamfer strip 80 is preferably a unitary, extruded aluminum member, which may be cut to any desired length and typically would run the entire length of a column in an unbroken strip. Chamfer 82 typically includes uniformly triangular cross sections of 45° right triangles having its hypotenuse, or face 86, exposed to the concrete that will be poured and its legs 88, 90 abutting the interior walls of adjacent panels 14. Tail 84 extends outwardly from leg 90 of the triangular cross section formed by chamfer 82 and lies snugly in channel 92 of side rail 22, being made in the exact shape of channel 22. The matched shape of tail 84 and channel 92 provide the only locating means necessary for precisely positioning chamfer strip 80 relative to form panels 14. A plurality of spaced holes 94 in tail portion 84 aligned with holes 60 in side rails 22, 24, also allows these members to be readily fastened together by means of bolt 96 and nut 98. Alternatively, chamfer strip 80 may include a tail 84 that has no aperture, which is intended for use with form panels 14 whose side rails 22, 24 do not have holes. In this embodiment, a set of conventional clamps as is used to fasten the adjacent form panels 14 together and to fasten chamfer strip 80 to form panels 14.

Figure 7:
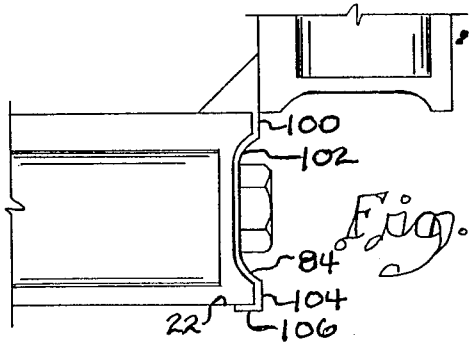
FIG. 7 is an enlarged, fragmentary sectional view corresponding to that of FIG. 5, but illustrating an alternative embodiment of the chamfer strip.

Referring to FIG. 7, tail 84 further comprises first flat tail portion 100, channel tail portion 102 having dimensions that allow for snug locating engagement with the channel side rail 22 (see, for example, FIG. 4) and second flat tail portion 104. The embodiment shown in FIG. 7 further includes flange 106 on the end of tail 84 remote from chamfer 82. Flange 106 is integrally formed with chamfer strip 80 and lie at a 90° angle with respect to flat tail portions 100, 104, and is bent to the left as shown in FIG. 7, providing a snap fit on side rail 22, hence providing a second means for locating chamfer strips 80 in relation to form panels 14.

When chamfer strip 80 is utilized in a mold whose panels are held together by an angle iron, as in the prior art, poured concrete frequently seeps between faces 16 and legs 88, 90 of chamfer 82, resulting in an unfinished appearance in the column, or pillar. This effect is partially due to a poor fit between the chamfer and the mold, and partially due to translation of outward forces of the poured concrete being translated into bending moments that distort the panel side rails and result in column corners that are not square, thereby disrupting a seal between the chamfer and the mold that may have been acceptable prior to the pouring of the concrete. When, however, chamfer strip 80 is used in conjunction with adjustable corner strip 10, as illustrated in FIG. 6, the square joinder of legs 88, 90 can be very accurately matched by a square joinder of panels 16 of adjacent form panels 14, bringing legs 88, 90 into tightly mating engagement with the corners of form panels 16 and side rails 22, 24, thereby preventing any seepage of concrete into that joint. The result is nearly perfectly formed chamfers.

In the preferred embodiment disclosed herein, the cross section of chamfer strip 80 is substantially a 45° right triangle whose hypotenuse defines the chamfer face 86 that will actually form the chamfer on the molded product. The specific shapes of corners, corner braces, and side rails, however, need not be those illustrated. The chamfer system shown here is designed for producing a flat-edged 45° bevel on a rectangular cross section concrete column. Naturally, the chamfer system disclosed herein can be readily adapted for producing other shapes of bevels, such as, for example, curved bevels (which may incorporate a portion of the circumference of a circle, a French curve, and so forth) a straight-edged bevel on a triangular, hexagonal, octagonal, and so forth shaped column or piece. This would require adjustments in the specific angles of adjustable corner strip 10 used for holding form panels together and in the specific shape and dimensions of the chamfer strip. Such design modifications are well within the skill of a person of ordinary skill in the art. Utilizing the techniques of the chamfer system disclosed herein any of a wide variety of different chamfers or bevels can be created, depending on the chosen shape and dimensions of chamfer 21. Utilizing the techniques of the adjustable corner strip 10 as disclosed herein a wide variety of different shaped columns or other building structures can be created.

Although the chamfer system here has been discussed primarily in connection with forms for molding poured concrete, it is apparent that form panels may be assembled in various designs to produce molds for concrete, indoor or outdoor plaster, clay, expanded polystyrene, rubber, any plastic materials that subsequently harden (for example, epoxy resins), or any other moldable material into a variety of shaped pieces.

It is to be understood that while certain forms of this invention have been illustrated and described, it is not limited thereto, except in so far as such limitations are included in the following claims.

Having thus described the invention, what is claimed as new and desired to be secured by Letters Patent is:

1. An apparatus for producing a chamfer on a molded concrete column comprising:

(a) four form panels each having side rails and formed into a mold having a rectangular cross section, each said panel defining one wall of a rectangular mold;

(b) at least one chamfer strip along at least one internal, lengthwise corner of said mold, said chamfer strip comprising a face for molding a chamfer and having two intersecting side walls, said intersecting side walls forming a corner at the intersecting edges of said walls for fitting into the corner of said mold; and said face comprising a surface formed by joining said side walls; and having an integrally formed tail extending outwardly as an extension from one said side wall and including means for fastening said chamfer strip to a mold panel;

(c) an adjustable corner strip fastened along the outside, lengthwise edge of each intersection of each two adjacent mold panels, said adjustable corner strip comprising respective flange means diverging angularly from a juncture and forming flexible resilient spaced winds, each said wing being for connection to respective side rails of adjoining concrete form panels; and (d) means for adjusting an angular divergence of said flange means from said juncture, and thereby adjusting angular relationships of adjoining said form panels.

2. The apparatus according to claim 1 wherein said fastening means further comprises a plurality of spaced holes.

3. An apparatus for forming one or more chamfers in molded products produced through use of form panels that are assembled to form a mold, comprising:

(a) a chamfer strip having a face for molding a bevel and two intersecting side walls, said intersecting side walls forming a corner at the intersecting ends of said side walls for fitting into a corner of a mold; and said face comprising a surface formed by joining the non-intersecting ends of said side walls;

(b) an integrally formed tail extending outwardly as an extension from one said side wall and having a means for fastening said chamfer strip to a mold panel;

(c) said tail is continuous throughout the length of said chamfer strip, integrally formed with said chamfer strip, said tail further including separately defined integral tail portions extending outwardly from one said wall in the order given below, comprising:

(i) a first flat tail portion joined to said chamfer strip;

(ii) a channel tail portion defining a longitudinally extending channel having a wall protruding out of a plane defined by said first flat tail portion and a second flat tail portion; and (iii) a flange connected to said second flat tail portion;

(d) whereby said protruding channel wall rests in a corresponding side wall recess to assist in accurate placement of said chamfer strip.

* * * * *